United States Patent [19]

Kurz

[11] Patent Number: 4,907,316

[45] Date of Patent: Mar. 13, 1990

[54] DEVICE FOR DISINFECTING ROOMS AND FLOOR COVERINGS

[75] Inventor: Gerhard Kurz, Stuttgart, Fed. Rep. of Germany

[73] Assignee: Interlava AG, Lugano, Switzerland

[21] Appl. No.: 302,949

[22] Filed: Jan. 30, 1989

[30] Foreign Application Priority Data

Feb. 9, 1988 [DE] Fed. Rep. of Germany ..... 3803825

[51] Int. Cl.[4] ..... A47L 9/28

[52] U.S. Cl. ..... 15/319; 15/339

[58] Field of Search ..... 15/324, 339, 319

[56] References Cited

U.S. PATENT DOCUMENTS

| | | | |
|---|---|---|---|
| 2,590,152 | 3/1952 | Buckey | 15/339 X |
| 2,632,912 | 3/1953 | Cuddeback | 15/339 X |
| 2,681,467 | 6/1954 | Guyer | 15/339 |
| 3,975,790 | 8/1976 | Patterson | 15/339 |
| 4,791,700 | 12/1988 | Bigley et al. | 15/324 |

FOREIGN PATENT DOCUMENTS

| | | | |
|---|---|---|---|
| 1082201 | 6/1954 | France | 15/339 |
| 648967 | 1/1951 | United Kingdom | 15/339 |

*Primary Examiner*—Chris K. Moore

*Attorney, Agent, or Firm*—Darby & Darby

[57] ABSTRACT

In connection with a device for desinfecting rooms of any desired type, including the furniture, curtains, floor coverings, carpets, and the like, contained in the rooms, it is proposed to arrange in the suction nozzle of a vacuum cleaner a UV radiator emitting a radiation having a disinfecting action so that any biologically detrimental substances can be fought directly at their place of origin. The UV radiator may be installed in vacuum cleaner nozzles of any kind, i.e. for example in plain floor nozzles, combined suction and beater nozzles, curtain nozzles, and the like.

12 Claims, 1 Drawing Sheet

DEVICE FOR DISINFECTING ROOMS AND FLOOR COVERINGS

BACKGROUND OF THE INVENTION

The present invention relates to a device according to the preamble of claim 1.

In order to clean rooms used as human dwellings from biological contaminations, i.e. germs and other microorganisms, viruses and bacteria, but also from bigger organisms, such as the well-known and dangerous household dust mite, numerous possibilities and approaches have become known. Only recently, for example, a special chemical substance has been introduced into the market which is intended for fighting the household dust mite (see journal "highTech 2/88, p. 63) and with which carpets and the like can be sprayed. However, the activity of this agent has been limited deliberately to the household dust mite and its disagreeable consequences, such as allergic reactions of persons which are attacked by this species of mite and its secretions. It must be questioned if it will be possible in this manner to fight the mite effectively, because this would require that all rooms be treated very carefully with the vaporized agent, which would mean a still further contamination for the environment since the agent must necessarily be based on chemical substances.

It has also been generally known for some time to use a disinfecting radiation in air conditioning systems or air humidifiers; and finally one has also tried to equip vacuum cleaners or similar devices in such a manner that the exhaust air generated by the vacuum cleaner is exposed to a disinfecting ultraviolet radiation (DE-OS No. 29 10 104; DE-OS No. 30 09 365). The exhaust air may be treated in this case either by subjecting it to the ultraviolet radiation in a gate, or by arranging a UV disinfector as a final filtering element for the exhaust air, wherein a plurality of UV radiators are arranged in longitudinal direction around a channel which is connected with the exhaust pipe (DE-OS No. 30 09 365).

It is a problem of these arrangements used for disinfecting the exhaust air of a vacuum cleaner that their principle consists in fighting only the consequences of the biological contamination of rooms, i.e. the microorganisms, fine dusts, bacteria and viruses, which have been picked up by the vacuum cleaner, while the place of origin, for example floor coverings of any type, rugs, curtains, upholstery, are not treated at all. Futher, it seems to be a problem that the exhaust air passes the disinfecting zone at considerable speed so that one cannot always be sure that all germs and other biological contaminations are subjected to a sufficient dose of the disinfectant. If this cannot be guaranteed, the treatment of the air in the vacuum cleaner only leads to the contaminant biological substances being additionally swirled. In any case, however, the evil cannot be pulled out by the root.

Now, it is the object of the present invention to remedy this situation and to ensure effectively, though over an extended period of time, that the disinfecting action of the UV radiation and/or a UV disinfector can be achieved efficiently and directly at the place of origin of the contamination, without any need for additional efforts or the use for the use of especially trained people.

ADVANTAGES OF THE INVENTION

The device according to the invention solves this problem and provides the advantage that the suction nozzle of a vacuum cleaner, which may have any desired design, is moved deliberately over all surfaces, at least in the area of the floor, but also over curtains and upholstery, at least once a week and sometimes even more often, in order to pick up any existing dusts, contaminations, particles, and the like, and to collect them in the dust bag. The invention now succeeds in directing the disinfecting action of the UV radiation exactly upon the area where the suction nozzle of the vacuum cleaner moves over the surfaces to be cleaned. And even when working very rapidly, i.e. when the suction nozzle is moved to and fro very rapidly, the irradiated area will surely be exposed to the desinfecting action of the UV radiation much longer than would be the case for the exhaust air flowing at high speed through the vacuum cleaner. For, the air volumes, which are drawn or pressed through the dust bag, move through the exhaust channel of the vacuum cleaner at considerable speed which means that the exposure time is correspondingly short.

It is another advantage of the present invention that due to the repeated application of the UV radiation, the disinfecting effect is repeated every week so that it is possible, in the long run, to arrive at virtually sterile rooms and to maintain this sterility in spite of the fact that the floors are constantly walked on and the rooms are in constant use. By repeating the work with the vacuum cleaner at least once a week, occasionally even more often, one simultaneously repeats the operation by which the biological contaminations, mites, germs, bacteria, viruses, or the like, are subjected to the disinfecting action of the UV radiation.

A particularly advantageous solution is achieved when the UV radiator is designed and mounted in the suction nozzle of the vacuum cleaner in transverse direction relative to the usual direction of the movement obtained when working with the vacuum cleaner, because this ensures that the whole surface over which the suction nozzle, for example, the floor nozzle, the combined brush and beater nozzle, and the like, is moved are disinfected continuously.

Advantageously, the arrangement may be provided with a movement sensor, which may have any design and which is capable of detecting if the nozzle is being moved by the operator of the vacuum cleaner, i.e. pushed over the material to be cleaned, or if it is at rest. When a predetermined rest time threshold-value has been exceeded, the UV radiator may then be switched off in order to avoid any influences that are not intended, possible discolorations, or the like, of the materials to be treated.

BRIEF DESCRIPTION OF THE DRAWING

One embodiment of the invention is illustrated diagrammatically in the drawing and will be described hereafter in more detail. In the drawing.

DESCRIPTION OF THE EMBODIMENTS

It is the basic idea of the present invention to arrange a UV radiator having a disinfecting effect in the area of the suction nozzle of a vacuum cleaner so that biological contaminants are exposed directly to the disinfecting action of the UV radiator at their very place of origin, and this repeatedly, i.e. every time floors, curtains, upholstery, or the like are treated by the vacuum cleaner, whereby the number of germs and of other biologically detrimental small objects and microorganisms can be reduced practically to the state of sterility, while previously the action was limited to full or partial disinfection of the exhaust air, with the consequence that basically the contaminated condition was not changed at all.

Figure 1:
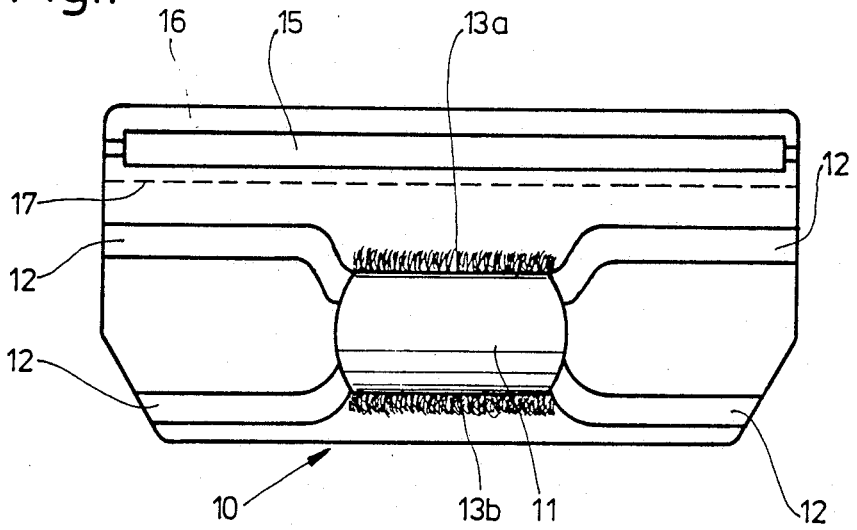
FIG. 1 shows a diagrammatic bottom view of one possible embodiment of a suction nozzle of a vacuum cleaner, with a supplementing compartment intended for receiving a UV disinfector.

In the representation of FIG. 1, the suction nozzle of the vacuum cleaner is designated by reference numeral 10; the illustrated nozzle is, preferably, a floor or suction nozzle comprising recessed suction channels 12 grouped around a suction inlet 11 in generally any desired arrangement, since the arrangement of the channels is of no importance for the invention. The suction insert itself may further comprise groups of brushes 13*a*, 13*b* arranged in front of and behind the nozzle (viewed in the direction of displacement during operation).

Figure 2:
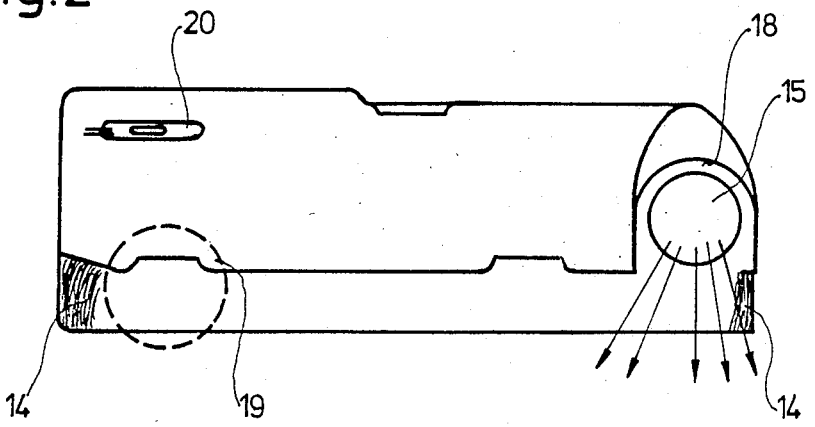
FIG. 2 shows a cross-section through the floor nozzle of FIG. 1, with certain parts omitted.

Such a floor nozzle for a vacuum cleaner may also be guided on rollers and when plain floors are to be worked it may also comprise a lowerable frame 14 of a brush-like structure which is not shown in FIG. 1, but indicated in FIG. 2.

A UV radiator 15 of a suitable oblong shape, which emits a UV radiation of a correspondingly strong disinfecting action, is mounted at a suitable point, preferably in a direction transverse to the operating direction or the direction of movement of the brush. The radiating width is then practically equal to the full width of the suction nozzle, corresponding to the length of the UV radiator tube, so that—if one allows for the normally overlapping movements during the cleaning operation—the entire area being cleaned by the suction nozzle 10 is simultaneously exposed to the disinfecting action of the radiation of the UV radiator 15.

The UV radiator 15 may be arranged in a separate compartment 16 of the suction nozzle 10, which must of course be open at the bottom, towards the material to be worked, in which case the mounting height of the UV radiator must of course be set off from the lower end face of the suction nozzle far enough to exclude any damage. However, it is also possible to protect the compartment 16 from interference from the outside by an additional transparent cover. Moreover, the compartment 16 may also be separated from the remaining area of the suction nozzle by an additional partition wall 17. It goes without saying that in order not to obstruct the cleaning action as such, the compartment 16 with the UV radiator contained therein may also be raised a little relative to the bottom surface of the floor coverings to be cleaned; further, it is recommended to arrange a reflecting material 18 behind the UV radiator tube 15, i.e. above and, if desired on both sides thereof, as viewed in FIG. 2, which material may also consist of a plastic half-shell with a corresponding reflecting coating, an aluminium reflector, or the like. This ensures that in addition to the radiation directed directly upon the material to be cleaned, the whole radiation emitted by the UV radiator 15 is reflected upon the material and its disinfecting effect is fully utilized.

It is understood that such a UV radiator with disinfecting effect can be suitably designed and used also in connection with other vacuum cleaner nozzles, for example, combined suction and beater nozzles, upholstery nozzles, curtain nozzles, and the like, so that the desinfecting action can be utilized wherever cleaning is effected, i.e. where dust and, consequently, biologically detrimental substances normally are encountered which action is then repeated very time the vacuum cleaner is used.

According to another advantageous improvement of the present invention, a movement sensor may be arranged, for example in the suction nozzle accommodating also the UV radiator 15, for switching off the UV radiator when the nozzle is not moved for a predetermined period of time, for example—just to state a numerical figure which is, however, not meant to limit the present invention—for three seconds. It is, thus, ensured that the radiation of the UV radiator will have no negative effect on the material to be treated.

In the case of a plain floor nozzle, such a movement sensor may be coupled, for example, with the small travelling wheels by which the nozzle moves about the floor and may be designed, for example, as an inductive or optical or also capacitive sensor deriving its information regarding the movement of the suction nozzle from the rotation of the wheel, via a transmitter. Such a wheel, which rotates when the suction nozzle is moved over the floor, is indicated by reference numeral 19 in FIG. 2. Another possibility to provide a movement sensor consists in the arrangement of a mercury transmitter (20) constituted by an oblong glass tube with two contacts on its one side and one mercury ball moving freely in its interior. Due to the constant reciprocating movement of the suction nozzle, the mercury inside the mercury transmitter (20) will move, too, and will repeatedly close the contacts so that every closing of the contacts will, for example, cause a monoflop with presettable response time to be triggered to its instable condition. This is possible because the mercury mass itself reacts as an inert mass in the mercury transmitter so that every time the direction of movement of the suction nozzle is reversed during operation, it will get into contact with the front or rear end of the tube of the mercury transmitter, closing the contacts at least once.

Alternatively, it is however also possible to arrange the contacts on both sides. Consequently, the constant swinging movement of the mercury mass is utilized as indication for the movement of the floor nozzle.

If the monoflop is permitted to run down, i.e. if no retriggering occurs within the predetermined time, then this is interpreted as an indication that the suction nozzle is no longer moved, and the monoflop will switch off the UV radiator 15 via a suitable triggering circuit, for example an intermediate relay, or the like. When the monoflop is retriggered, a high signal appears at its other output, and the relay is released again for triggering the UV radiator 15. The movement sensors may have many different designs which need not be described here in detail.

All features described in the specification, the following claims and the drawing may be essential to the invention either alone or in any combination thereof.

What is claimed is:

1. A vacuum cleaner for simultaneous cleaning and disinfection of rooms and the contents thereof, comprising at least one radiator emitting an ultraviolet radiation having disinfecting effect, said at least one ultraviolet radiator being installed in a suction nozzle of the vacuum cleaner, the radiation emitted by said ultraviolet radiator being directed upon the changing areas being worked by said suction nozzle, and a movement sensor in said suction nozzle, said sensor switching off said ultraviolet radiator when said nozzle is not moved for a time exceeding a predetermined period of time.

2. A vacuum cleaner according to claim 1, wherein said UV radiator is an oblong tube arranged transversely to the normal direction of movement during operation of said suction nozzle of the vacuum cleaner, said radiator filling the width of said suction nozzle.

3. A vacuum cleaner according to claim 2, wherein said UV radiator is in a compartment separated from the remaining nozzle area.

4. A vacuum cleaner according to claim 3, wherein said compartment is covered by a protective cover which is transparent for the disinfecting UV radiation.

5. A vacuum cleaner according to claim 1, and further comprising a reflecting material arranged opposite the surface to be treated, and being at least one of behind and to the side of said UV radiator tube, which material reflects radiation emitted by said UV radiator upon the surface to be treated.

6. A vacuum cleaner according to claim 5, wherein said reflecting material takes the form of a half-shell with a reflecting inner coating, said UV radiator being at least in part enclosed by said half-shell.

7. A vacuum cleaner according to claim 1, wherein said cleaner has a travelling wheel and said movement sensor includes a transmitter detecting the rotation of said travelling wheel during operation.

8. A vacuum cleaner according to claim 1, wherein said movement sensor triggers a monoflop circuit, said monoflop retaining said UV radiator in the active condition for a predetermined time period, after said time period said monoflop turning off said UV radiator, repeated triggering maintaining said UV radiator in the active condition, cessation of triggering by movement of said suction nozzle turning off said UV radiator.

9. A vacuum cleaner according to claim 8, wherein said movement sensor includes a mercury switch.

10. A vacuum cleaner for simultaneous cleaning and disinfection of rooms and the contents thereof, comprising at least one radiator emitting a radiation having disinfecting effect, said at least one radiator being installed in a suction nozzle of the vacuum cleaner, the radiation emitted by said radiator being directed upon a changing areas being worked by said suction nozzle, and switching means for making said radiator operable only with motion of said nozzle over said surface being worked.

11. A vacuum cleaner for simultaneous cleaning and disinfection of rooms and the contents thereof, comprising disinfecting means within a portion of said vacuum cleaner for disinfecting materials exposed thereto, said disinfecting means having an On state, wherein disinfecting of said materials is accomplished and an Off state where disinfecting is not accomplished, and switch means for placing said disinfecting means in said On state only with motion of said cleaner over a surface being worked.

12. A vacuum cleaner for simultaneous cleaning and disinfection as claimed in claim 1, wherein said suction nozzle is one of a floor nozzle, combined suction and beater nozzle, upholstery nozzle, and curtain nozzle.

* * * * *